US007219706B2

(12) United States Patent
Stager

(10) Patent No.: US 7,219,706 B2
(45) Date of Patent: May 22, 2007

(54) APPARATUS HAVING ADJUSTABLE SAWS FOR WOOD CUTTING

(75) Inventor: Bradley R. Stager, Beaverton, OR (US)

(73) Assignee: Key Knife, Inc., Tualatin, OR (US)

( * ) Notice: Subject to any disclaimer, the term of this patent is extended or adjusted under 35 U.S.C. 154(b) by 0 days.

(21) Appl. No.: 10/236,842

(22) Filed: Sep. 6, 2002

(65) Prior Publication Data

US 2004/0045634 A1 Mar. 11, 2004

(51) Int. Cl.
*B27C 1/00* (2006.01)

(52) U.S. Cl. ..... 144/218; 144/231; 144/237

(58) Field of Classification Search ..... 144/39, 144/176, 218, 219, 237, 220, 231–235; 407/31, 407/58, 55; 451/541, 544, 546, 547
See application file for complete search history.

(56) References Cited

U.S. PATENT DOCUMENTS 1,432,580 A * 10/1922 Vauclain et al. ..... 407/31
3,323,567 A * 6/1967 Segal ..... 144/223
3,780,778 A 12/1973 Chapman
3,976,112 A * 8/1976 Rowlson et al. ..... 144/237
4,327,789 A 5/1982 Reuter
4,335,767 A 6/1982 Reuter
4,848,427 A 7/1989 Reuter
5,421,386 A 6/1995 Lundstrom
5,983,967 A * 11/1999 Gross et al. ..... 144/235
6,058,992 A 5/2000 Stager et al.
6,167,929 B1 1/2001 Stager et al.
6,189,196 B1 * 2/2001 Weathers ..... 144/237

FOREIGN PATENT DOCUMENTS

CH 384848 4/1961
DE 1 528 197 4/1965
DE 3208377 A1 10/1983
DE 295 19 657 U1 8/1996
DE 196 01 086 A1 7/1997
EP 0 273 914 10/1986
EP 0 744 255 A2 11/1996

(Continued)

*Primary Examiner*—Shelley Self
(74) *Attorney, Agent, or Firm*—Birdwell & Janke, LLP

(57) ABSTRACT

An apparatus having adjustable saws for wood cutting. A cutting head has at least two spaced apart disk-saws for producing respective slicing cuts in an article of wood, the saws defining respective distinct outer cutting diameters. Preferably, the disk-saws are bolted to the cutting head and spaced apart therefrom adjustable amounts by interdisposed control plates of predetermined thicknesses. Preferably, a first one of the disk-saws defines an annular ring having an inner diameter, and the outer cutting diameter for the first disk-saw is greater than the outer cutting diameter of a second one of the disk-saws. The outer cutting diameter of the second disk-saw is then less than the inner diameter of the first disk-saw, so that the second disk-saw is nested inside the first disk-saw while remaining axially displaceable therefrom. Preferably, the cutting head is relieved behind at least the cutting teeth of the second disk-saw to permit sawdust that migrates past the second disk-saw, into the space defined by the inner diameter of the first disk-saw, the second disk-saw and the cutting head, to exit through the cutting head.

15 Claims, 8 Drawing Sheets

FOREIGN PATENT DOCUMENTS

| | | |
|---|---|---|
| EP | 0 933 177 A2 | 1/1999 |
| FR | 79 22107 | 9/1979 |
| FR | 79 22108 | 12/1979 |
| FR | 81 22198 | 11/1981 |
| WO | WO 87/02297 | 4/1987 |

* cited by examiner

Fig. 6
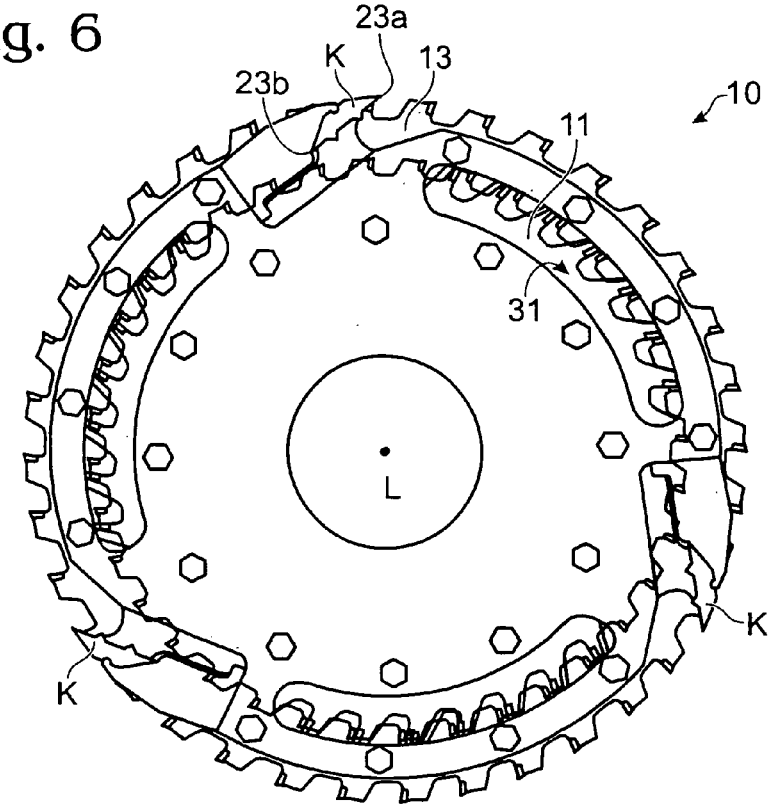
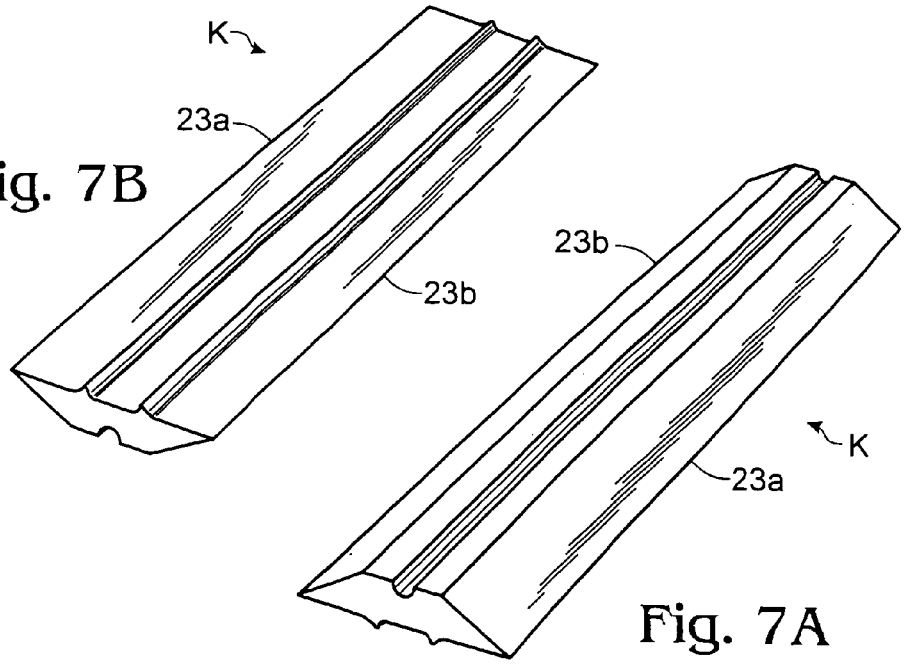
Fig. 7B
Fig. 7A

Fig. 10A
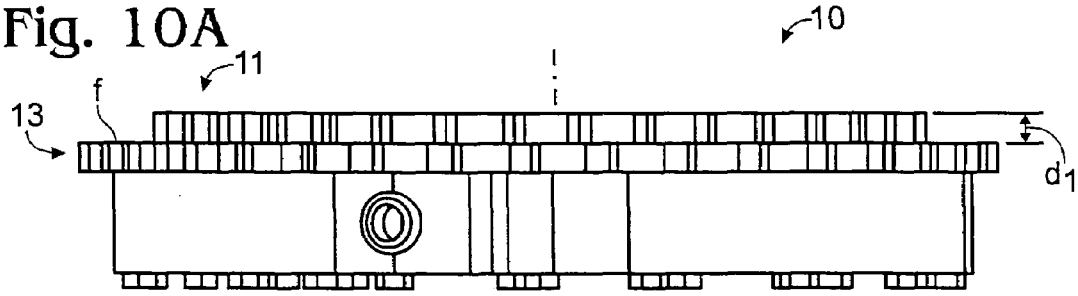
Fig. 10B
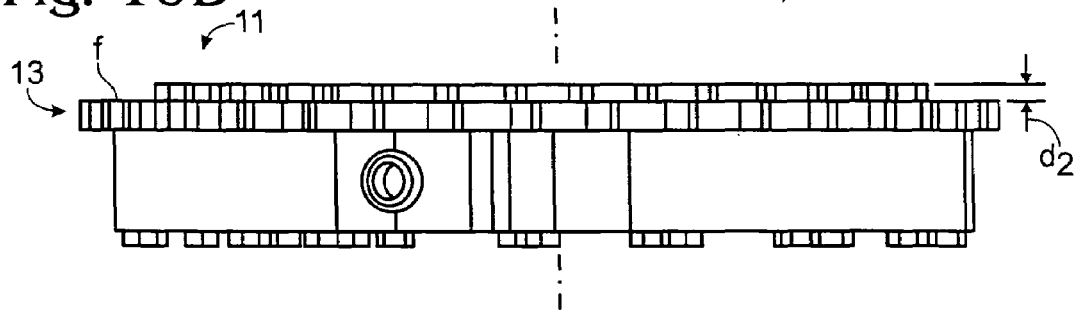
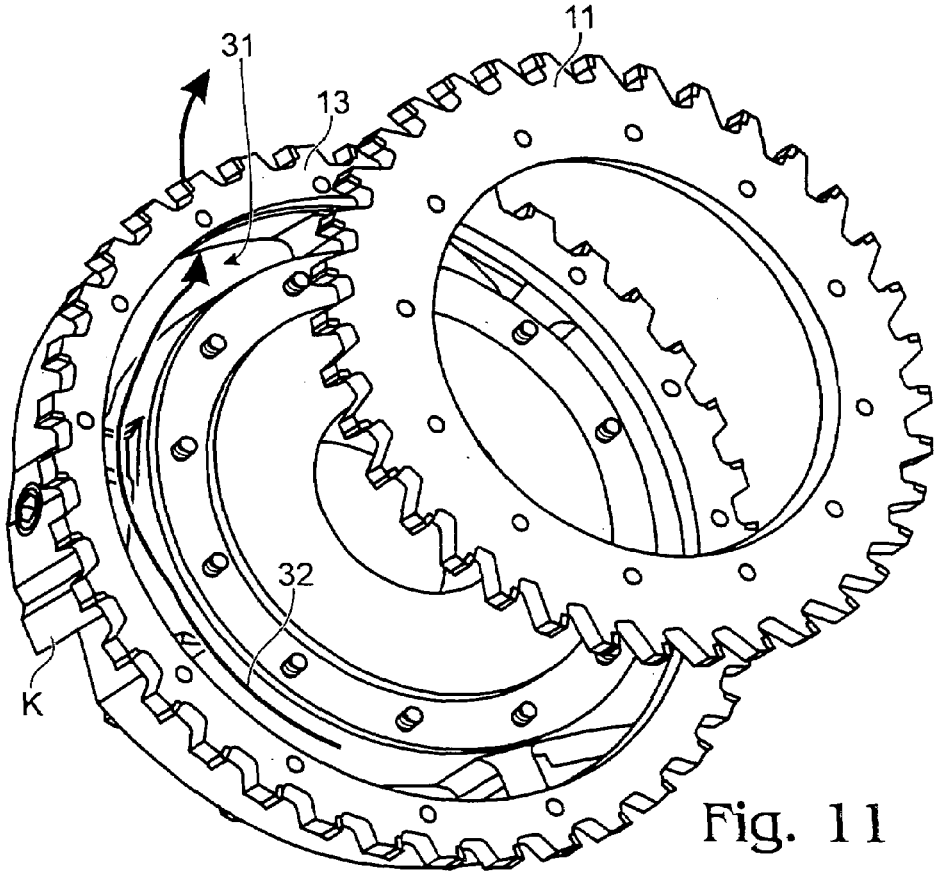
Fig. 11

APPARATUS HAVING ADJUSTABLE SAWS FOR WOOD CUTTING

FIELD OF THE INVENTION

The present invention relates to an apparatus having adjustable saws for wood cutting, particularly for use in log and lumber processing in a lumber mill.

BACKGROUND OF THE INVENTION

In order to produce squared lumber from a log, curved or wany edges of the log must be removed. To optimize the number of boards that can be obtained from the log, boards of optimum size are identified that will substantially fill the cross-sectional area of the log, leaving a number of such wany edges. In a process known as "profiling," a cutting head (also known as a "profiling head") is used to cut or chip away the wany edges, and this may be done before the boards are sawed from the log. Particularly, the cutting head cuts a corner that extends along the length of the log and that defines an outer side of one board and at least part of the upper or lower face of an adjacent board. To cut the corner, the cutting head rotates about an axis and has cutting surfaces oriented at right angles with respect to each other.

The cutting head has in the past typically included a knife for cutting the aforementioned upper or lower face in the example given above, the face defining a plane that is parallel to the axis of rotation of the cutting head ("facing cut"), and a saw for cutting the aforementioned outer side ("slicing cut"), which defines a plane that is perpendicular to the axis of rotation. More recently, cutting heads have been provided which employ knives for making both the slicing cut and the facing cut.

The speed of the profiling operation is increased if the wany edges for a number of boards can be removed by the same cutting head. A cutting head that can be used to cut away two wany edges at one time has at least one additional set of knives. The knives of the additional set are disposed a different radial distance from the axis of rotation than the first knives and are displaced axially therefrom as well.

For example, the first knives may be used to cut a first corner defined by an outer side of a first board and at least part of the upper face of a second board that lies beneath and extends laterally beyond the first board. The additional knives may simultaneously be used to cut an adjacent corner defined by an outer side of the second board and at least part of the upper face of a third board that lies beneath and extends laterally beyond the second board. The difference in radial positioning of the first knives relative to the additional knives, as well as the difference in axial positioning of the first knives relative to the additional knives, may define either the thickness of one of the boards or the difference in width between two adjacent boards. The absolute positioning of all of the knives of the cutting heads used to profile the log, in concert with the positioning of the cutting heads themselves, defines the dimensions of board lumber sawn from the log.

Examples of adjustable cutting heads are found in Dietz, Disclosure Document DE 44 19 324 ("Dietz") and Linck, European Patent Application No. 96107714.6 ("Linck"). Dietz discloses an outer corner milling machine and an inner corner milling machine, each resembling a pot, one lying at least partially within the other. Each of the corner milling machines is adapted to cut a corner and is equipped for this purpose with a cleaver on the circumference surface and a plane blade oriented at right angles to the cleaver. "Adjustment units" are used to adjust the axial spacing between the two corner milling machines. The "adjustment units" are not described, but appear to be electric motors. Radial adjustment is not provided, and axial adjustment appears to require feed-back control of the motors to find and maintain a command spacing. This spacing can change as a result of the forces encountered by the milling machines and at least some time will be required for the controller and feedback mechanism to restore proper spacing, resulting in imprecise cutting.

Linck discloses a milling head having a large diameter ring of cleavers and a smaller diameter ring of cleavers. The cleavers have their cutting edges aligned with the axis of revolution of the milling head. The cleavers are attached to cleaver carriers which are fastened with screws to respective cleaver supports. The radial disposition of the cleaver supports can be adjusted by loosening the screws. The cleaver supports can also be moved in axial rails within the carriers and can be locked in at different axial positions with terminal blocks and screws. Disksaw segments are installed between the cleavers in the smaller ring. These are stated as being adjustable but no means for adjusting the disksaw segments is disclosed. Moreover, while the position of the cleavers can be adjusted both axially and radially, holding the cleavers in position depends on frictional forces exerted by tightening screws, so that there is no provision for positively locking the position of the cleavers.

Another problem with such cutting heads generally is that they are prone to load up with sawdust.

Accordingly, there is a need for an apparatus with adjustable saws for wood cutting that provides for the advantages inherent in the use of saw blades for cutting multiple corners in the wood, outstanding ease of adjustment and positive locking of the saws in their cutting positions, and resistance to the accumulation of sawdust, to minimize required maintenance and maximize the effectiveness of the wood cutting process.

SUMMARY OF THE INVENTION

The invention disclosed herein is an apparatus having adjustable saws for wood cutting. Within the scope of the invention, there is a cutting head adapted for rotation about an axis, the cutting head having at least two spaced apart disk-saws for producing respective slicing cuts in an article of wood, the saws defining respective distinct outer cutting diameters. The disk-saws may comprise separate disk-saw segments.

In a preferred embodiment of the invention, the cutting head includes in addition at least one set of knives for producing respective facing cuts in the article of wood, the sets of knives defining distinct outer cutting diameters.

Preferably, the disk-saws are bolted to the cutting head and spaced apart therefrom adjustable amounts by interdisposed control plates of predetermined thicknesses.

Preferably, a first one of the disk-saws defines an annular ring having an inner diameter, and the outer cutting diameter for the first disk-saw is greater than the outer cutting diameter of a second one of the disk-saws. The outer cutting diameter of the second disk-saw is then less than the inner diameter of the first disk-saw, so that the second disk-saw is nested inside the first disk-saw while remaining axially displaceable therefrom.

Preferably, the cutting head is relieved behind at least the first disk-saw to permit sawdust that migrates past the cutting teeth of the second disk-saw, into the space defined by the inner diameter of the first disk-saw, the second disk-saw and the cutting head, to exit through the cutting head.

Therefore, it is a principal object of the present invention to provide a novel and improved apparatus having adjustable saws for wood cutting.

It is another object of the present invention to provide such an apparatus that provides for the advantages inherent in the use of saw blades for cutting multiple corners in the wood.

It is a still another object of the present invention to provide such an apparatus providing for ease of adjustment of the cutting position of the saws.

It is yet another object of the present invention to provide such an apparatus providing for positive locking of the saws in respective cutting positions.

It is a further object of the present invention to provide such an apparatus that minimizes required maintenance and maximizes the effectiveness of the wood cutting process.

It is yet a further object of the present invention to provide such an apparatus that minimizes the accumulation of sawdust on the saws.

The foregoing and other objects, features and advantages of the present invention will be more readily understood upon consideration of the following detailed description of the invention, taken in conjunction with the following drawings.

BRIEF DESCRIPTION OF THE DRAWINGS

FIG. 6 is a side view of the cutting head of FIG. 4, showing a rear side of the cutting head.

FIG. 7A is a pictorial view of a representative knife for use with the present invention, showing a top side of the knife.

FIG. 7B is a pictorial view of the knife of FIG. 7A, showing a bottom side of the knife.

FIG. 10A is a plan view of the cutting head of FIG. 4, showing nested disk-saws in a first relative axial position.

FIG. 10B is a plan view of the cutting head of FIG. 8A, showing the nested disk-saws in a second axial position.

FIG. 11 is an exploded view of the cutting head of FIG. 4, showing a rear side of the cutting head.

DETAILED DESCRIPTION OF A PREFERRED EMBODIMENT

Figure 1:
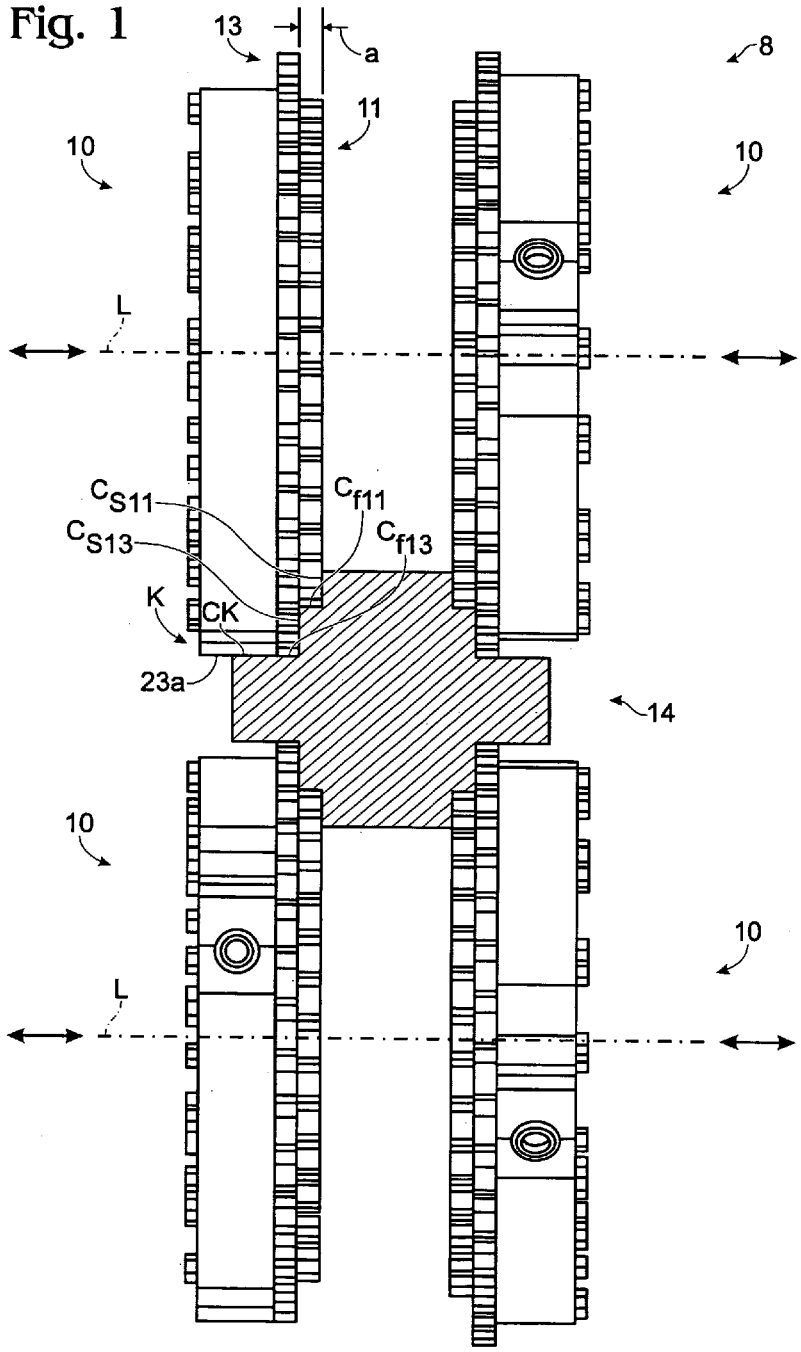
FIG. 1 is a plan view of an apparatus for cutting an article of wood according to the present invention.
Figure 2:
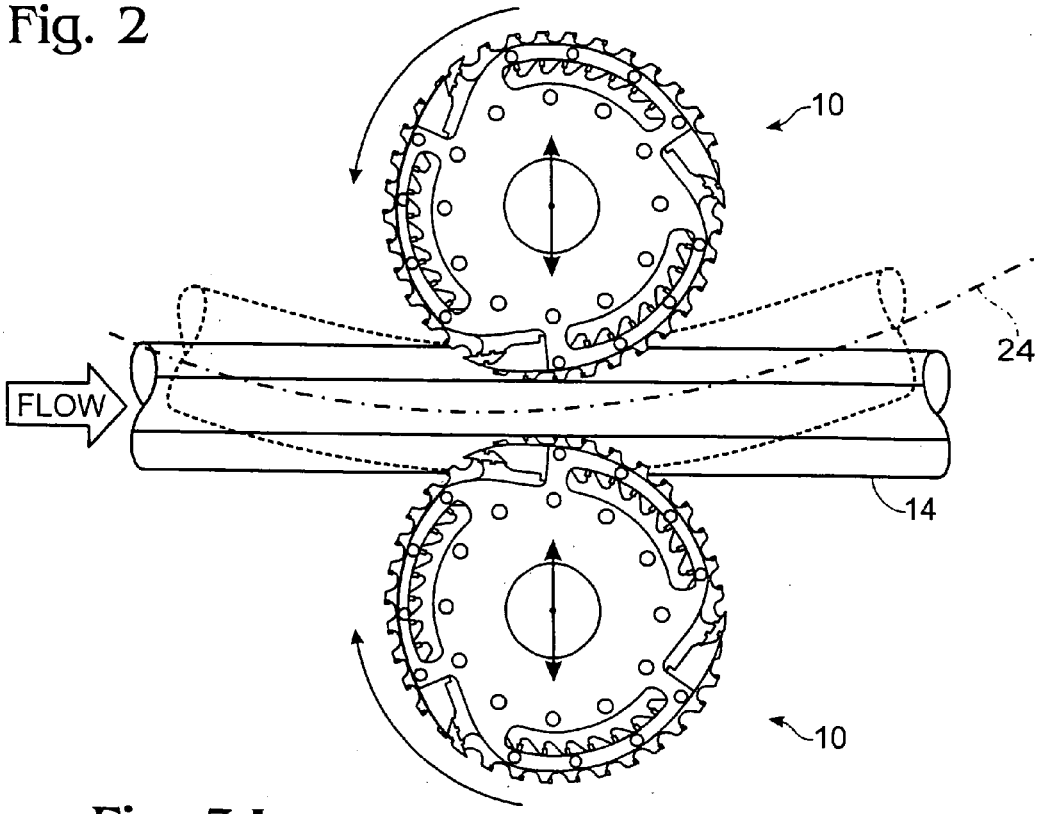
FIG. 2 is side elevation of the apparatus of FIG. 1.
Figure 3A:
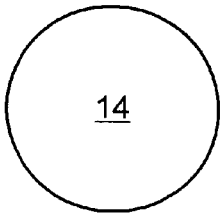
FIG. 3A is a cross-section of a log.

Referring to FIG. 1, an apparatus 8 for cutting an article of wood 14 is shown with four cutting heads 10. The article of wood 14 is, in this example, a log shown in cross-section. Corners are being cut from the log by the cutting heads 10 as the log passes the cutting heads in the direction indicated as "flow" in FIG. 2 in a milling process known as "profiling." This process configures the log from the roughly circular cross-section shown in FIG. 3A to that shown in FIG. 3B. While such profiling of logs is an exemplary use of the present invention, the apparatus 8 may be used for cutting any article.

Figure 3B:
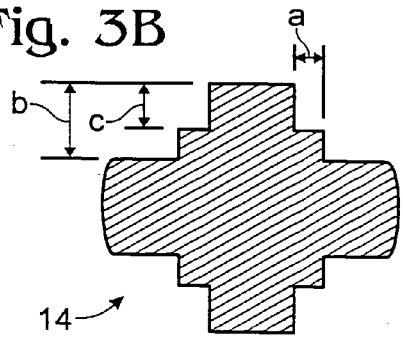
FIG. 3B is a cross-section of the log of FIG. 3A as operated on by the apparatus of FIG. 1.
Figure 3C:
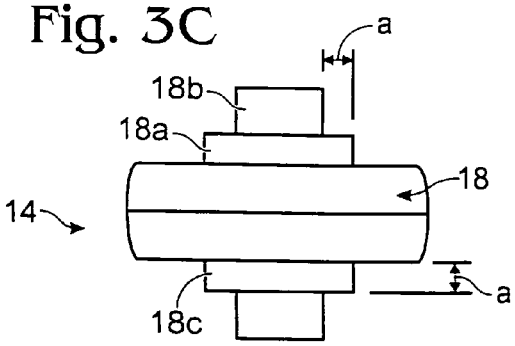
FIG. 3C is the cross-section of FIG. 3B shown with boards of lumber identified.

By cutting wany edges from the log with the cutting heads, the cross-section of the log as shown in FIG. 3B has been optimized for cutting pieces 18 of board lumber, as depicted in FIG. 3C. The cutting heads 10 rotate about respective axes of rotation "L" as shown in FIG. 1. The cutting heads may be moved in the direction of the arrows shown in FIGS. 1 and 2 to accommodate logs of different diameters.

Figure 4:
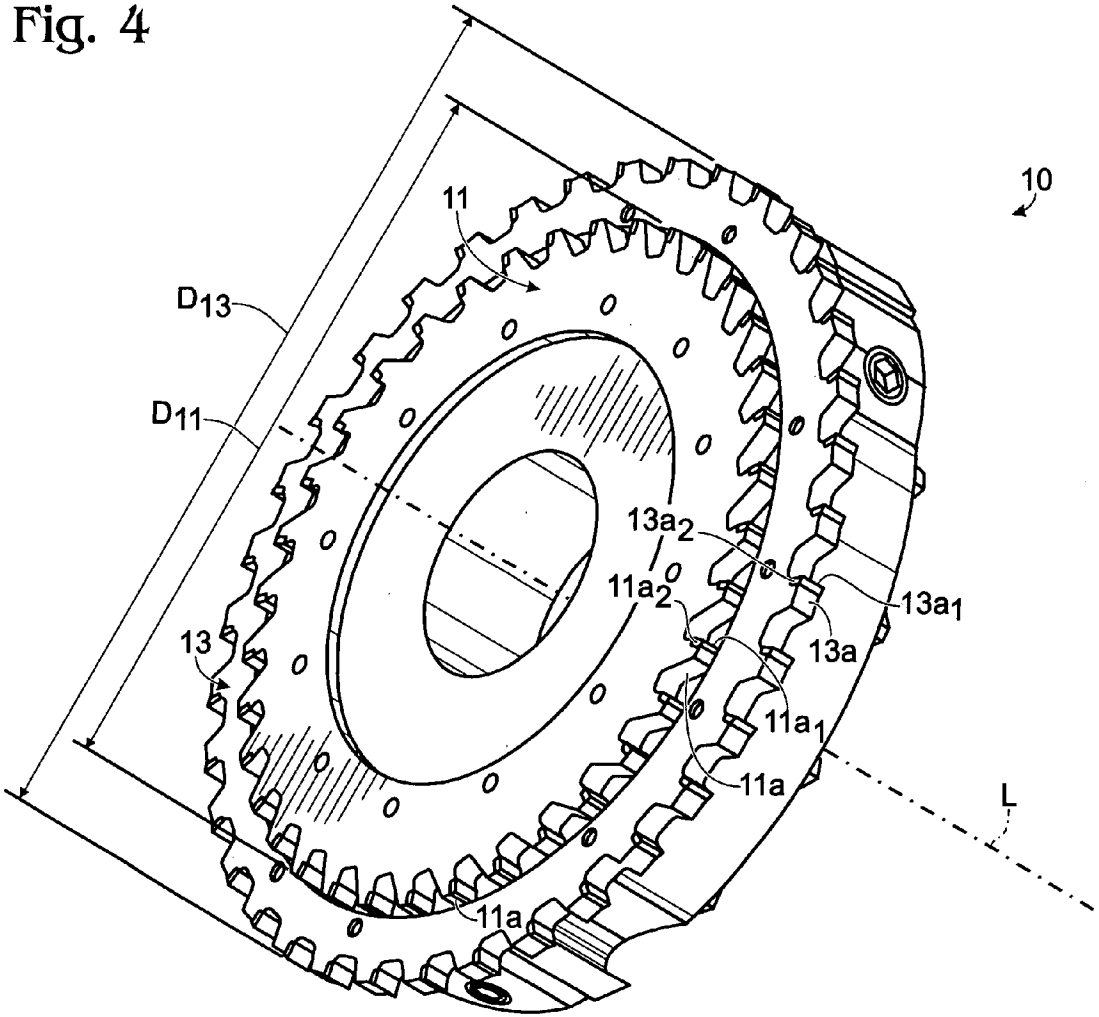
FIG. 4 is a pictorial view of a cutting head according to the present invention, showing a front side of the cutting head.

Turning to FIG. 4, a preferred cutting head 10 having adjustable saws according to the present invention has two disk-saws 11, 13 with associated cutting teeth 11*a*, 13*a*. Each cutting tooth 11*a*, 13*a* has two perpendicular cutting edges $\mathbf{11}a_1$ and $\mathbf{11}a_2$, and $\mathbf{13}a_1$ and $\mathbf{13}a_2$, respectively. The cutting edges $\mathbf{11}a_1$ and $\mathbf{13}a_1$ are parallel to the axis or rotation "L," and the cutting edges $\mathbf{11}a_2$ and $\mathbf{13}a_2$ are perpendicular to the axis.

The disk-saws are spaced apart along the axis "L." The cutting teeth 11*a*, 13*a* define distinct outer cutting diameters $D_{11}$ and $D_{13}$ of the disk-saws. The outer cutting diameter of the disk-saw 13 is chosen as being the greater outer cutting diameter for purposes of the discussion herein. While shown as integral parts for simplicity, the flat, circular disk-saws 11 and 13 may comprise any number of separate disk-saw segments, which may facilitate repair and replacement of the disk-saws, as well as maintenance of the apparatus generally. Also, while two disk-saws are shown and described as preferred, any number of disk-saws may be provided. Referring back to FIG. 1, the disk-saws 11 and 13 of a particular cutting head 10, as they are rotated about the axis "L," produce respective slicing cuts $C_{s11}$, $C_{s13}$, and facing cuts $C_{f11}$, $C_{f13}$, on the log 14.

Figure 5:
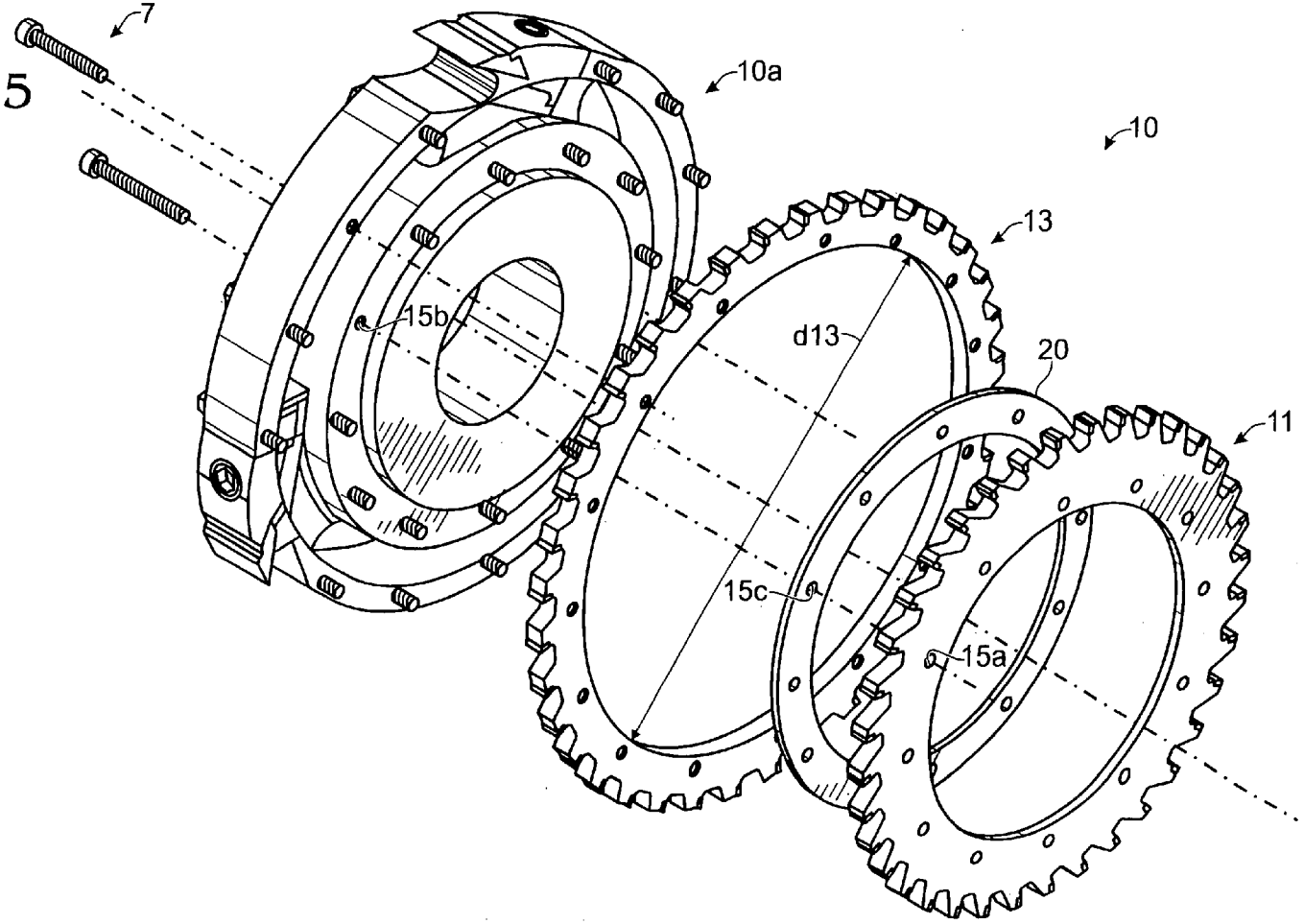
FIG. 5 is an exploded view of the cutting head of FIG. 4.

An outstanding feature of the cutting head 10 according to one aspect of the invention is that it provides for adjusting the relative axial positioning of the disk-saws 11, 13, by the inclusion or deletion of one or more control plates 20, such as shown in FIG. 5. Both the absolute and relative axial positions of the disk-saws may be adjusted by appropriate selection and placement of the control plates 20. In the example shown, a single control plate 20 is interdisposed between the disk-saw 11 and a body portion 10*a* of the cutting head 10. Additional control plates 20 may be stacked together with the control plate 20, and any number of similar control plates may be interdisposed between the disk-saw 13 and the body portion 10*a*.

In a preferred embodiment of the invention, the control plates include apertures 15*c* matching corresponding apertures 15*a* and 15*b*, through the disk-saw and the body portion respectively, permitting bolts 15 used to mount the disk-saws to the cutting head 10 to pass therethrough. Other adaptations of the control plates 20 and the cutting head 10 may be employed to achieve the same function without departing from the principles of the invention.

As shown in FIG. 5, the control plates are flat pieces of metal of predetermined thickness, preferably, though not necessarily formed in an annular configuration. While a single annular control plate is shown for axially positioning the disk-saw, smaller, individual control plates may be employed at selected bolt locations to produce the same result.

The difference in the relative axial positioning between the disk-saws 11 and 13 is shown in FIG. 1 as the distance "a." Referring to FIG. 3C, this distance "a" may be used to define either the difference in width between two adjacent boards 18*a* and 18*b*, or the thickness of a single board 18*c*. The absolute positioning of the disk-saws 11 and 13 of opposed pairs of cutting heads 10 provides the absolute dimensions of the boards 18. The control plates provide for such positioning in discrete, precisely defined steps, and positioning is positively and accurately maintained without readjustment regardless of the amount of use and wear of the cutting head.

The control plates are highly economical to produce, and provide for substantially reducing the mechanical complexity of the cutting head, resulting in further savings in initial cost, maintenance and repair. By use of the control plates 20, the dimensions of different boards 18 may be optimized to minimize the amount of the wany material that must be removed from the log and thereby to maximize the size of the boards.

Turning to FIG. 6, according to another aspect of the invention, the cutting head 10 preferably includes in addition to the disk-saws at least one set of knives K. A representative knife K having dual cutting edges 23*a*, 23*b* is shown in FIGS. 7A and 7B. The knives K as they rotate about the axis "L" produce respective semi-cylindrical facing cuts $C_K$ (FIG. 1) on the log 14. The outer cutting edges (23*a* as shown in FIG. 6) of the knives K define an outer cutting diameter for the knives with respect to the axis of rotation "L." Additional sets of knives may be employed, and the axial and radial positioning of the knives may be adjustably controlled with control plates similar to the control plates 20, such as described in the assignee's patent application Ser. No. 10/081,444.

Figure 8:
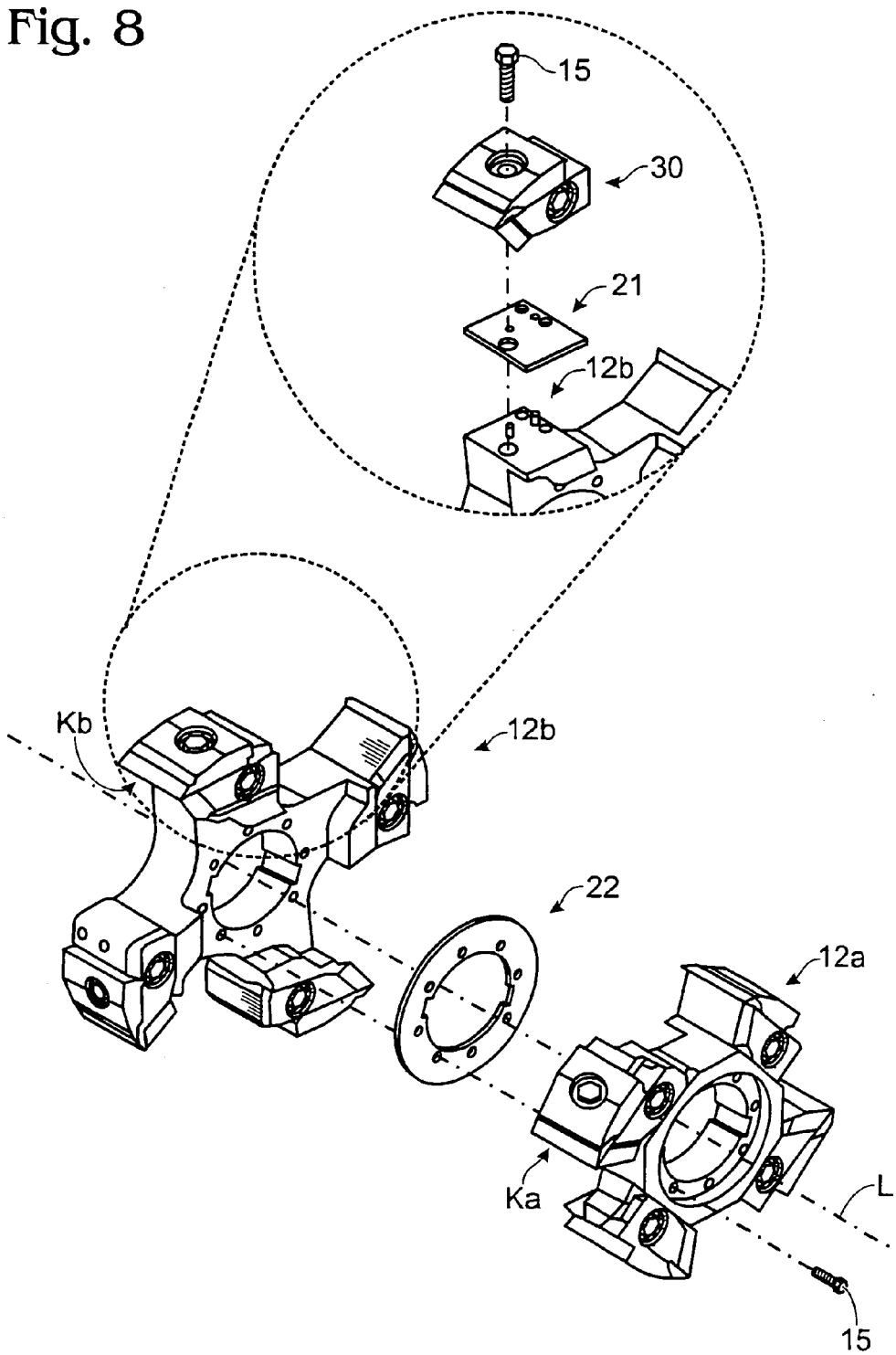
FIG. 8 is an exploded view of a portion of a cutting head having two sets of knives according to the present invention.
Figure 9:
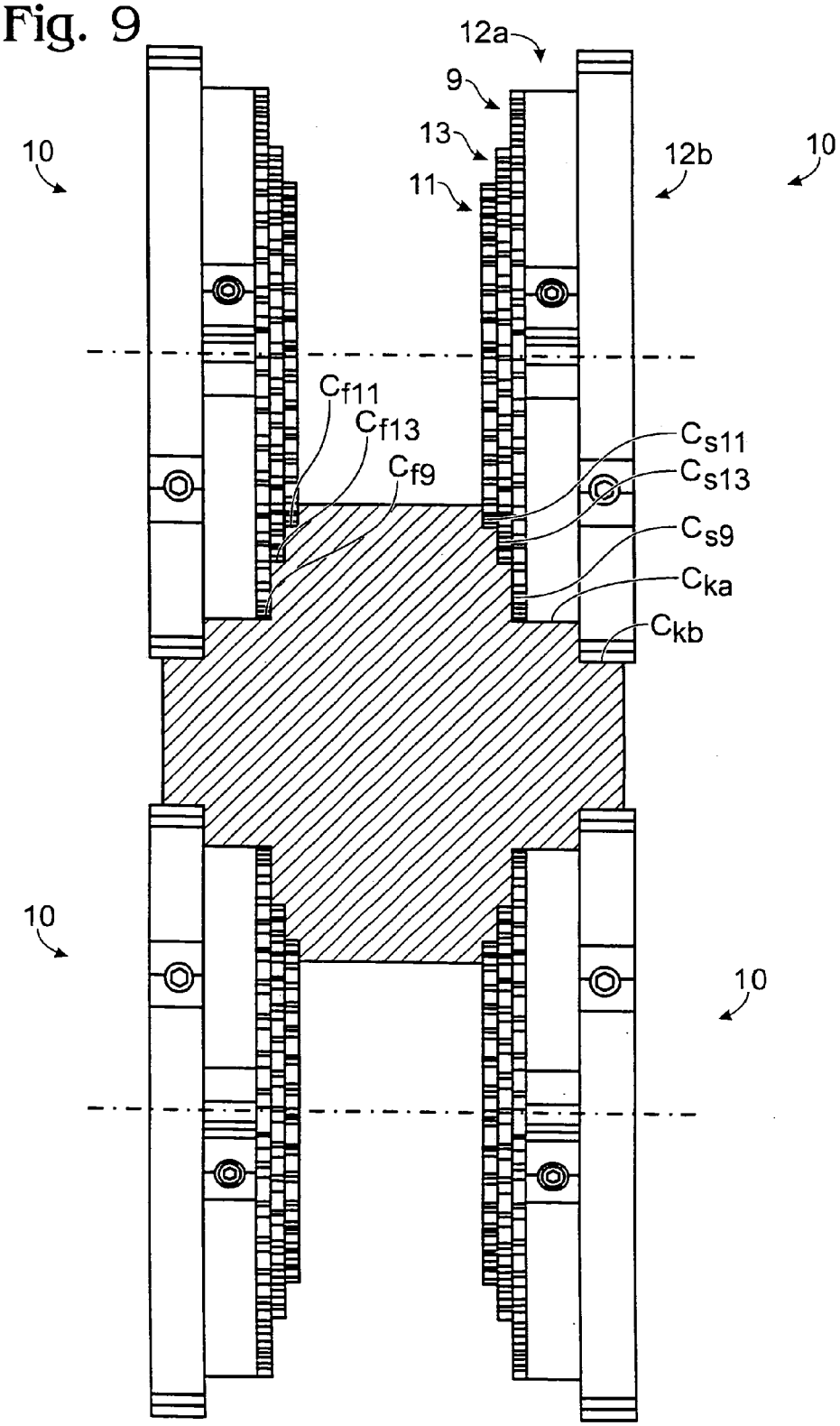
FIG. 9 is a plan view of a second embodiment of an apparatus for cutting an article of wood according to the present invention.

For example, turning to FIGS. 8 and 9, a first set of four knives $K_a$ may be provided on a body portion 12*a* that is bolted to the cutting head 10 for producing a facing cut $C_{ka}$ on the log at a first outer cutting diameter. A second set of knives $K_b$ may also be provided on a body portion 12*b* that is bolted either to the cutting head 10 (not shown in FIG. 8) or the body portion 12*a* for producing a facing cut $C_{kb}$ on the log at a second outer cutting diameter that is distinct from the outer cutting diameter of the first set of knives $K_a$. Base outer cutting diameters are defined by the radial size of the respective body portions 12.

In addition, the radial positioning of the knives may be further adjusted from their base radial positioning as defined by the body portions 12 themselves, by the use of one or more control plates 21 (FIG. 9) interdisposed between clamping mechanisms 30 for the knives and the body portions 12 and held in place such as by the use of bolts 15. Like the control plates 20, the control plates 21 are flat pieces of metal of predetermined thickness that provide for such positioning in discrete, precisely defined steps, and positioning is positively and accurately maintained without readjustment regardless of the amount of use and wear of the cutting head.

FIG. 8 also illustrates the use of a control plate 22 providing for relative axial positioning of the two sets of knives $K_a$ and $K_b$. One or more of the control plates 22 may be interdisposed between the body portions 12*a* and 12*b* and held in place such as by the use of bolts 15. As will be readily appreciated, suitably disposed control plates 22 may also be used to adjust the absolute axial positions of the two sets of knives. Like the control plates 20, the control plates 22 are flat pieces of metal of predetermined thickness that provide for such positioning in discrete, precisely defined steps, and positioning is positively and accurately maintained without readjustment regardless of the amount of use and wear of the cutting head.

FIG. 9 also illustrates the use of three disk-saws, 11, 13 and 9, to show how the concept may be generalized. The disk-saws produce respective slicing cuts $C_{s11}$, $C_{s13}$, and $C_{s9}$, and respective facing cuts $C_{f11}$, $C_{f13}$, and $C_{f9}$, on the log 14. The facing cut $C_{f9}$, in particular, is aligned with the facing cut $C_{ka}$ of the adjacent set of knives $K_a$, i.e., the outer cutting diameter of the disk-saw 9 is the same as the outer cutting diameter of the set of knives $K_a$. Additional disk-saws may also be employed as desired, along with any number of sets of knives or any other desired elements.

Turning to yet another aspect of the invention, as mentioned, the disk-saws define respective outer cutting diameters D. In FIGS. 4-6, the disk-saw referred to as 13 is shown as having a greater outer cutting diameter $D_{13}$ than the outer cutting diameter $D_{11}$ of the disk-saw 11. In that case, the disk-saw 13 is preferably provided as an annular ring having a corresponding inner diameter $d_{13}$ (see FIG. 5). As seen most clearly in FIG. 4, the outer cutting diameter $D_{11}$ of the disk-saw 11 is preferably less than the inner diameter $d_{13}$ of the disk-saw 13, so that the disk-saw 11 may be nested axially within the disk-saw 13 and may therefore be adjusted to extend axially beyond the disk-saw 13 any desired amount. For example, comparing FIGS. 10A and 10B, the disk-saw 11 is shown in a first relative position (FIG. 10A) in which the disk-saw 11, nested in the disk-saw 13, extends axially beyond a front face "f" of the disk-saw 13 an amount "$d_1$" and a second relative position (FIG. 10B) in which the disk-saw 11 extends beyond the front face of the disk-saw 13 a lesser amount "$d_2$" while remaining nested within the disk-saw 13.

In addition, also as best seen in FIG. 4, it is preferable that the diameter $D_{11}$, of the disk-saw 11 is just slightly less than the inner diameter $d_{13}$ of the disk-saw 13, so that the space available therebetween for conducting sawdust into the cutting head 10 is minimized. Preferably, the radial clearance between the nested disk-saws is no greater than about 0.020", to minimize packing of sawdust between the disk-saws.

FIG. 11 illustrates still another aspect of the invention in which, preferably, the cutting head 10 is relieved such that there is an aperture 31 therethrough (also shown in FIG. 6), and there is a route as shown at 32 behind at least the cutting teeth of the smaller diameter disk-saw 11 to the aperture 31, for conducting sawdust entering the space between the disk-saws into the cutting head to the exterior of the cutting head. For example, even where the two cutting heads are nested together and the clearance between the outer cutting diameter $D_{11}$ (FIG. 4) of the cutting head 11 and the inner diameter $d_{13}$ (FIG. 5) of the cutting head 13 is essentially zero, sawdust may still enter the cutting head through the spaces between the cutting teeth 11*a*. The reliefs 31 and 32 cooperate with the maximum radial clearance indicated above to minimize or prevent packing of sawdust around the disk-saws.

Referring back to FIG. 2, it may be noted that the log 14 may be curved, having a curved elongate axis 24. In that circumstance, the heads 10 may all be moved together, upwardly or downwardly in the direction of the arrows, to follow the curvature of the log as it is fed along the direction of flow. This permits profiling a curved log according to the invention in such manner as to follow the grain, which optimizes the strength of the resulting lumber. The curved boards resulting from profiling the curved log may be straightened in subsequent processing with known techniques.

It is to be recognized that, while a particular adjustable profiling head for a wood cutting apparatus has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. An apparatus for cutting an article, comprising:

a cutting head adapted for rotation about an axis, said cutting head including at least one set of elongate cutting knives having respective linear cutting edges; and at least two coaxially disposed flat circular disk-saws, each disk-saw having respective pluralities of cutting teeth, said disk-saws attached to said cutting head and defining respective distinct outer cutting diameters, each of said cutting teeth having two cutting edges, one of said cutting edges being oriented parallel to said axis and the other of said cutting edges being oriented perpendicular to said axis, for producing, as a result of said rotation, both slicing and facing cuts in the article.

2. The apparatus of claim 1, wherein a first one of said disk-saws defines an annular ring having an inner diameter, the outer cutting diameter of said first disk-saw being greater than the outer cutting diameter of a second one of said disk-saws, the outer cutting diameter of said second disk-saw being less than the inner diameter of said first disk-saw for nesting said second disk-saw inside said first disk-saw.

3. The apparatus of claim 1, wherein said disk-saws are axially adjustably spaced relative to one another.

4. The apparatus of claim 3, further comprising at least one control plate interdisposed between at least one of said disk-saws said cutting head, for axially positioning said at least one disk-saw with respect to said cutting head.

5. The apparatus of claim 4, further comprising at least two control plates, at least one control plate being interdisposed between a first said disk-saw and said cutting head, and at least one control plate being interdisposed between the first said disk-saw and a second said disk-saw.

6. The apparatus of claim 4, wherein a first one of said disk-saws defines an annular ring having an inner diameter, the outer cutting diameter of said first disk-saw being greater than the outer cutting diameter of a second one of said disk-saws, the outer cutting diameter of said second disk-saw being less than the inner diameter of said first disk-saw for nesting said second disk-saw inside said first disk-saw.

7. The apparatus of claim 6, wherein the inner diameter of said first disk-saw, said second disk-saw and said cutting head define a space therebetween, and wherein said cutting head is relieved behind at least said cutting teeth of said second disk-saw to permit sawdust that migrates past said second disk-saw into the space and out through said cutting head.

8. The apparatus of claim 7, further comprising at least two control plates, at least one control plate being interdisposed between a first said disk-saw and said cutting head, and at least one control plate being interdisposed between the first said disk-saw and a second said disk-saw.

9. The apparatus of claim 2, wherein the inner diameter of said first disk-saw, said second disk-saw and said cutting head define a space therebetween, and wherein said cutting head is relieved behind at least said cutting teeth of said second disk-saw to permit sawdust that migrates past said second disk-saw into the space and out through said cutting head.

10. The apparatus of claim 3, wherein a first one of said disk-saws defines an annular ring having an inner diameter, the outer cutting diameter of said first disk-saw being greater than the outer cutting diameter of a second one of said disk-saws, the outer cutting diameter of said second disk-saw being less than the inner diameter of said first disk-saw for nesting said second disk-saw inside said first disk-saw.

11. An apparatus for cutting an article of wood, comprising: a cutting head adapted for rotation about an axis, said cutting head including at least two flat circular disk-saws axially adjustably spaced relative to each other, each disk-saw having respective pluralities of cutting teeth, said disk-saws attached to said cutting head and defining respective distinct outer cutting diameters for producing respective slicing cuts, wherein a first one of said disk-saws defines an annular ring having an inner diameter, the outer cutting diameter of said first disk-saw being greater than the outer cutting diameter of a second one of said disk-saws, the outer cutting diameter of said second disk-saw being less than the inner diameter of said first disk-saw for nesting said second disk-saw inside said first disk-saw.

12. The apparatus of claim 11, further comprising at least one control plate interdisposed between at least one of said disk-saws and said cutting head, for axially positioning said at least one disk-saw with respect to said cutting head.

13. The apparatus of claim 12, further comprising at least two control plates, at least one control plate being interdisposed between a first said disk-saw and said cutting head, and at least one control plate being interdisposed between the first said disk-saw and a second said disk-saw.

14. The apparatus of claim 12, wherein the inner diameter of said first disk-saw, said second disk-saw and said cutting head define a space therebetween, and wherein said cutting head is relieved behind at least said cutting teeth of said second disk-saw to permit sawdust that migrates past said second disk-saw into the space and out through said cutting head.

15. The apparatus of claim 11, wherein the inner diameter of said first disk-saw, said second disk-saw and said cutting head define a space therebetween, and wherein said cutting head is relieved behind at least said cutting teeth of said second disk-saw to permit sawdust that migrates past said second disk-saw into the space and out through said cutting head.

* * * * *